US005743310A

United States Patent [19]

Moran

[11] Patent Number: 5,743,310

[45] Date of Patent: Apr. 28, 1998

[54] SINGLE-HANDLED BANDING TOOL HAVING MULTIPLE PIVOT POINTS

[75] Inventor: Richard T. Moran, Denver, Colo.

[73] Assignee: Band-It-IDEX, Inc., Denver, Colo.

[21] Appl. No.: 651,452

[22] Filed: May 22, 1996

[51] Int. Cl.[6] ..... B21F 9/02

[52] U.S. Cl. ..... 140/123.6; 140/93.4

[58] Field of Search ..... 140/93.2, 123.6, 140/93.4

[56] References Cited

U.S. PATENT DOCUMENTS

| | | | |
|---|---|---|---|
| 1,989,669 | 2/1935 | Harvey | 81/9.1 |
| 2,087,655 | 7/1937 | Prestwich | 81/9.1 |
| 2,882,934 | 4/1959 | Gerrard | 140/93.2 |
| 3,344,815 | 10/1967 | Lawson et al. | 140/93.2 |
| 3,782,426 | 1/1974 | Morgan et al. | 140/123.6 |
| 3,837,211 | 9/1974 | Gress et al. | 72/410 |
| 4,047,545 | 9/1977 | Paradis | 140/123.6 |
| 4,646,393 | 3/1987 | Young | 24/20 |
| 4,726,403 | 2/1988 | Young et al. | 140/93.4 |
| 4,928,738 | 5/1990 | Marelin et al. | 140/93.4 |
| 4,997,011 | 3/1991 | Dyer et al. | 140/123.6 |

FOREIGN PATENT DOCUMENTS

| | | | |
|---|---|---|---|
| 658135 | 2/1963 | Canada | 140/123.6 |

*Primary Examiner*—Lowell A. Larson

*Attorney, Agent, or Firm*—Sheridan Ross P.C.

[57] ABSTRACT

A single-handled banding tool is disclosed, as well as a lock configuration for maintaining tension within a band clamp about a desired object. The handle of the banding tool may be utilized for actuating band loading operations, band tensioning operations, and band locking/cutting operations. During band loading operations and band tensioning operations, the handle pivots about a first pivot point, whereas during band locking/cutting operations, the handle pivots about a second point different from the first point. The two pivot points of the handle are controlled by a toggle system which compares the desired tension set by the operator with the tension in the band. When the ratio of the preset tension to the band tension exceeds a certain, predetermined amount, the toggle system moves the pivot point of the handle from the first pivot point to the second pivot point. In one embodiment and with the toggle system positioned to have the handle pivot about the second pivot point, the band locking/cutting assembly of the banding tool cuts across the entire with of the band along an arcuate path which reduces the amount of forces required to be applied by the operator for band locking/cutting operations.

42 Claims, 12 Drawing Sheets

SINGLE-HANDLED BANDING TOOL HAVING MULTIPLE PIVOT POINTS

FIELD OF THE INVENTION

The present invention generally relates to the field of tensioning a band about an object and, more particularly, to a single-handle banding tool in which the handle pivots about a first pivot point to tension the band and in which the handle pivots about a second pivot point to cut the band.

BACKGROUND OF THE INVENTION

There have been significant developments to date in relation to the manner in which metal bands are secured about various objects (e.g., cables, wiring, pipes) to provide a band clamp, as well as the tools which are used for these operations. Pertinent aspects of these types of operations include the manner in which the band is loaded into the banding tool, the manner in which the band is tensioned, the manner in which the band is locked at the desired tension, and the manner in which the band is cut. The particular banding application at issue may influence/dictate the requirements for the banding tool and/or the manner in which the band is applied. Certain applications may require the use of a powered banding tool (e.g., pneumatic) based upon, for instance, tensioning requirements. Other applications may require a hand-operated banding tool based upon, for instance, space limitations which may also have an effect on the manner in which tensioning, locking, and/or cutting operations are performed. Regardless of whether the banding tool is powered or hand-driven, simplification of the entire banding operation is always desirable from the standpoint of the user.

SUMMARY OF THE INVENTION

The present invention relates to tools and methods which are used to tension a band clamp about an object (e.g., wires, cables, pipes). The invention is embodied in a single-handled banding tool in which a single handle controls at least band tensioning and band cutting operations, with the handle pivoting about different points for each of these operations. Fundamental components of the banding tool include a first handle, a band tensioning assembly, and a band cutting assembly. Tensioning operations entail pivoting the first handle substantially about a first pivot point. This pivotal movement of the first handle translates into an advancement of the band tensioning assembly in a manner which in turn advances the band relative to the banding tool to introduce tension into the band and/or to remove any "slack" existing in the band. Multiple strokes of the first handle through the noted pivoting motion may and typically will be required in order for the band to the tensioned to the desired level. Upon completion of the tensioning operations, the first handle is caused to pivot about a second pivot point which is different from the first pivot point in that it is spaced therefrom. Pivotal movement of the first handle about the second pivot point translates into an advancement of the band cutting assembly in a manner which cuts the band (and which may further lock the band). In one embodiment this cutting operation entails cutting across the entire with of the band, preferably along an arcuate path. No movement of the main body of the banding tool relative to the band is required for these band cutting operations, which may also simultaneously lock the band at the desired tension.

The above-noted first handle may also be utilized in the loading of the band into the banding tool. Description of this feature will be made in reference to a band tensioning assembly which includes a tensioning assembly housing having a base and with a gripper pivotally interconnected therewith. The first handle includes a gripper pivot pin which is fixed relative to the first handle and which operatively interfaces with the gripper. Pivoting of the first handle about the first pivot point, but in a direction opposite of that which actuates tensioning operations (e.g., an operation in which the band tension is currently being increased), pivots the gripper away from the base of the tensioning assembly housing and allows for substantially unimpeded movement of the band relative to the band tensioning assembly. As such, a user need only use one hand to operate the banding tool such that the user's other hand may be used for inserting the band into the banding tool.

In one embodiment, the above-described first handle includes a first handle pivot pin. Control of a location of this first handle pivot pin may be used in turn to control whether pertinent components of the banding tool are configured for band tensioning operations or band cutting operations. During tensioning operations the first handle may pivot substantially about the first handle pivot pin such that the first handle pivot pin is the first pivot point. The first handle pivot pin may be maintained at the location coinciding with the first pivot point by exerting a force on the first handle pivot pin. In cases where the banding tool includes the ability to preset the desired tension for the band, the magnitude of the forces exerted on the first handle pivot pin to retain such in the location coinciding with the first pivot point may be proportional to the preset desired tension for the band.

The first handle pivot pin may be moved after tensioning operations are complete from the location coinciding with the first pivot point to another location. This may be the result of the ratio of the preset tension to the band tension is greater than a predetermined amount, which would then cause the noted movement of the first handle pivot point. This movement of the first handle pivot pin may then be utilized to activate the band cutting assembly. As noted, when the first handle pivots about a second pivot point different from the first pivot point, band cutting are affected. Movement of the first handle pivot pin from the location coinciding with the first pivot point to another location as described above operatively interfaces the first handle with the band cutting assembly. Subsequent pivoting of the first handle about the above-noted second pivot point causes the first handle pivot pin to act on the band cutting assembly to affect band cutting operations. In one embodiment, the second pivot point coincides with the above-noted actuator pin of the first handle which operatively interfaces the gripper of the band tensioning assembly.

The control of the above-described first handle pivot pin may be affected by a toggled linkage system. A portion of this toggled linkage system may operatively interface with a device for preloading the toggled linkage system. Preloading of the toggled linkage system may in turn be used for establishing a desired tension for the band clamp. For instance, when the band has been tensioned to a preestablished level, the toggled linkage system collapses. Collapsing of the toggled linkage system then moves the first handle pivot pin from the location coinciding with the first pivot point to the other location as described above such that the first handle will then pivot about the second pivot point. Prior to collapsing, the toggled linkage system may be use to forcibly retaining the first handle pivot pin in the location corresponding with the first pivot point.

DETAILED DESCRIPTION

Figure 1:
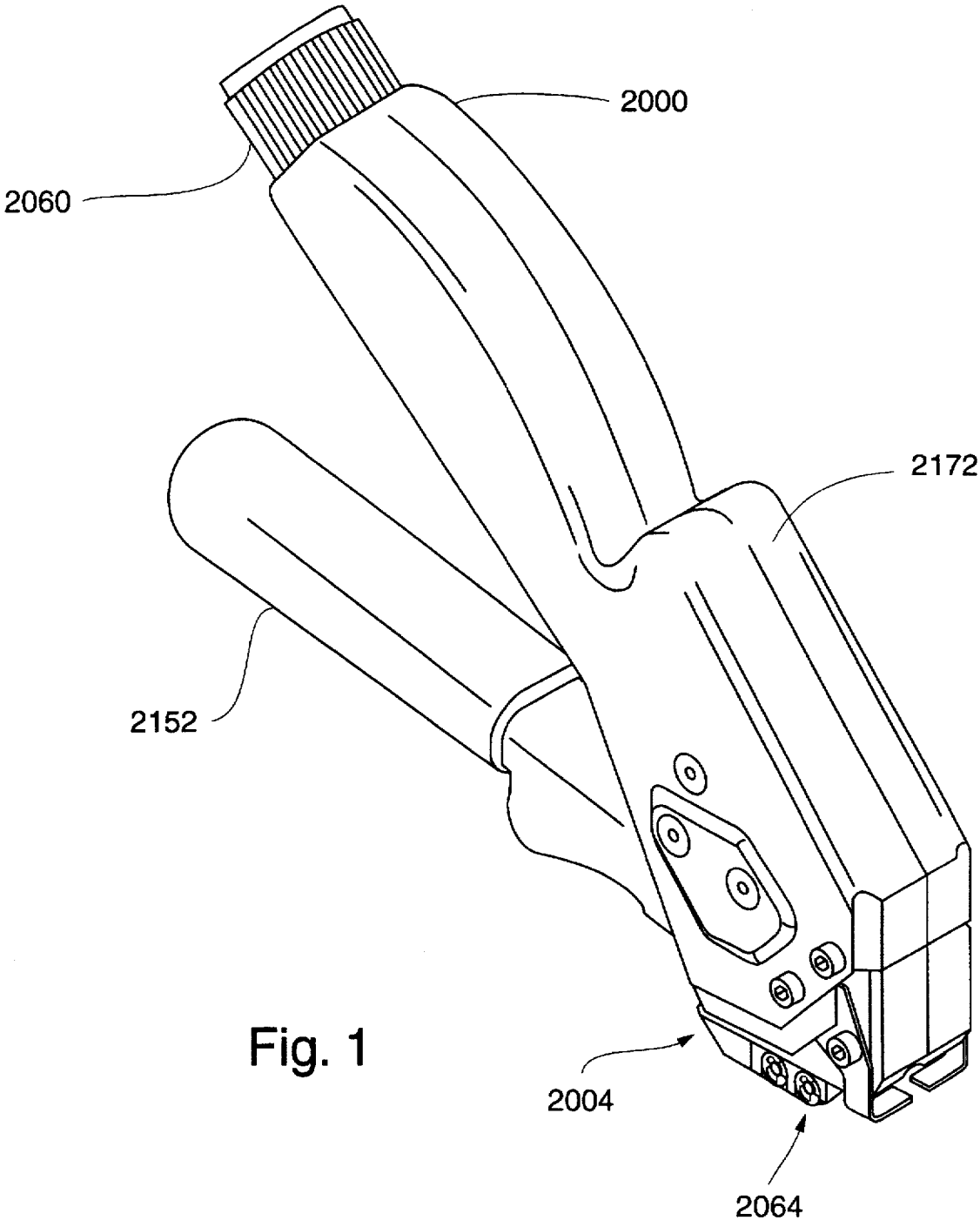
FIG. 1 is one embodiment of a single-handle banding tool.
Figure 2:
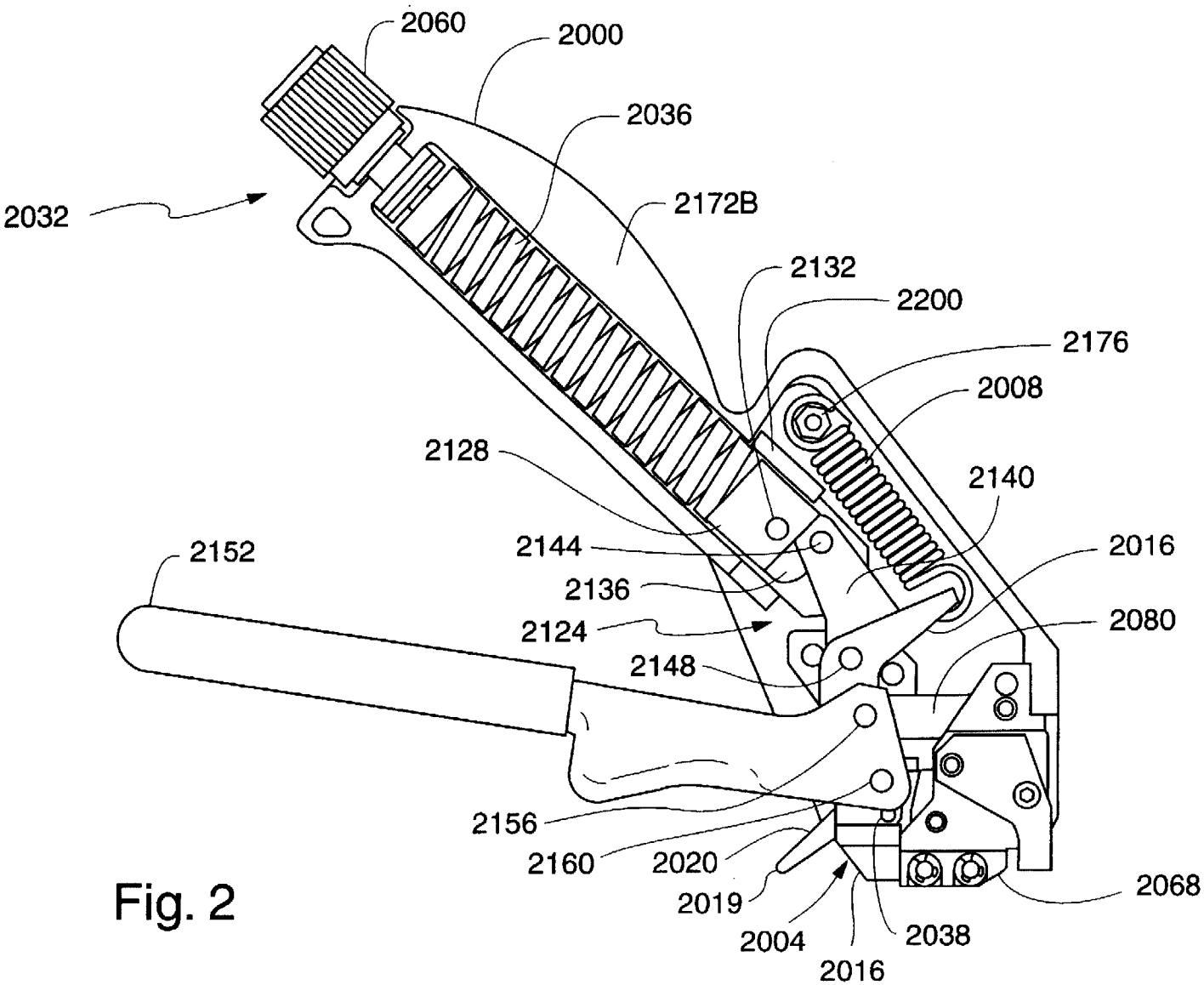
FIG. 2 is a cutaway view of the banding tool of FIG. 1.

Another embodiment of a banding tool is generally illustrated in FIGS. 1–2. The banding tool 2000 utilizes a multi-functional single handle 2152 in that it may be used to actuate a variety of operations. Loading of an appropriate band (not shown) into the banding tool 2000 may be accomplished by pivoting the handle 2152 counterclockwise (in the type of views presented in FIGS. 1–2) relative to a main body 2172 of the banding tool 2000. Band tensioning operations may also be affected by pivoting the handle 2152 clockwise (in the type of views presented in FIGS. 1–2) relative to the body 2172 of the banding tool to provide a power stroke for actively tensioning the band through a band tensioning assembly 2004. The handle 2152 may of course be pivoted in a counterclockwise direction (in the type of views presented in FIGS. 1–2) to provide a return stroke such that the handle 2152 resumes its neutral position (e.g., for subsequent band tensioning operations as generally described). Finally, band locking/cutting operations are provided by pivoting the handle 2152 through a single power stroke and in a clockwise direction (in the type of views presented in FIGS. 1–2) from the handle's 2152 neutral position which actuates a band locking/cutting assembly 2064. Notably, the pivot point for the handle 2152 is different for band loading/tensioning operations locking/cutting to band locking/cutting operations. This is provided by a toggle assembly 2124 which controls the pivot point of the handle 2152 based upon a comparison of a preselected tension established by the operator and the tension in the band.

The various components of the banding tool 2000 are illustrated in more detail in FIGS. 3–6. The banding tool 2000 includes a body 2172 as previously noted. Access to these various components is provided by having the body 2172 being separable into a first body housing 2172A and a second body housing 2172B. The first body housing 2172A and second body housing 2172B are appropriately interconnected by a plurality of screws 2196. As such, the banding tool 2000 may be readily disassembled if required.

Figure 3:
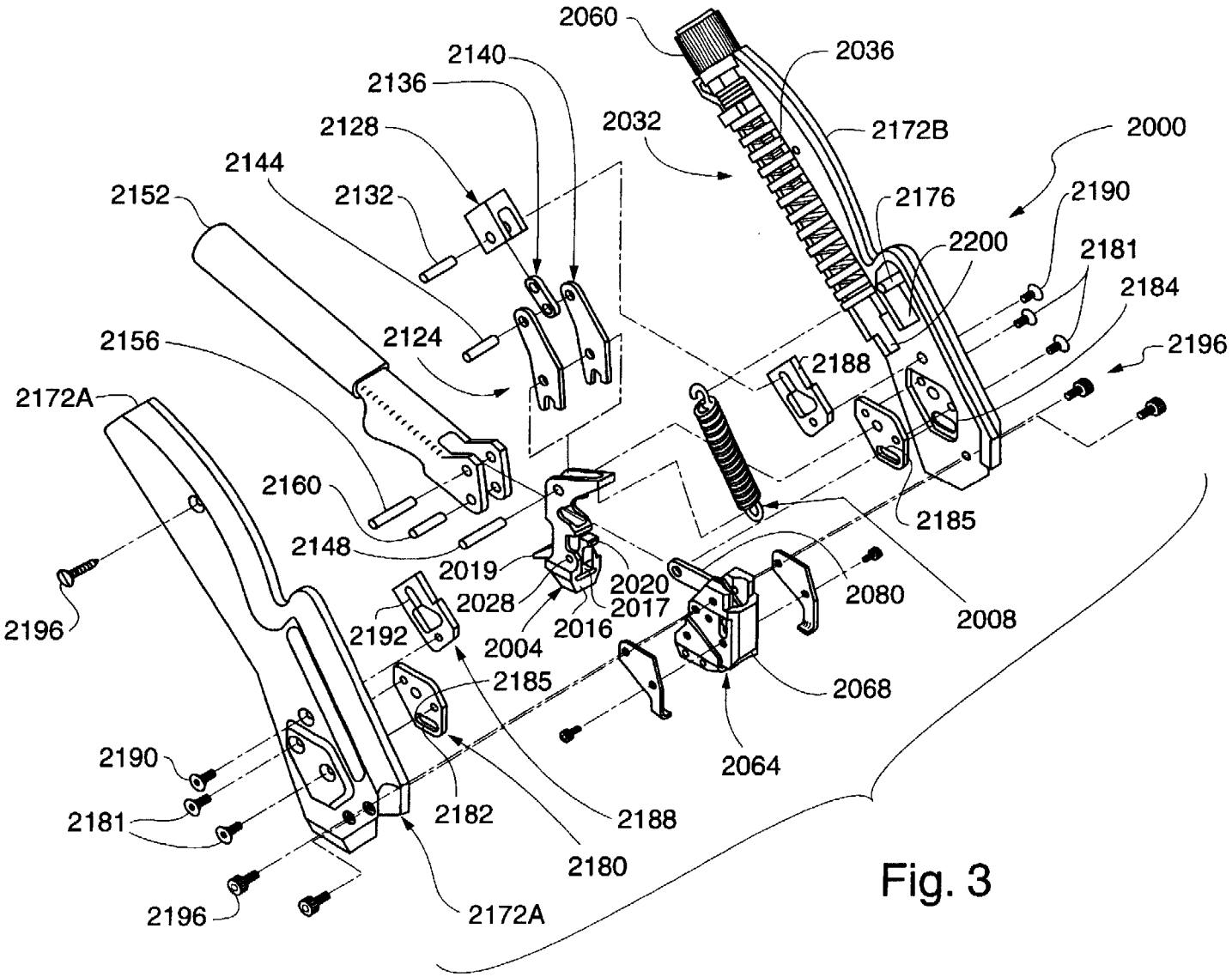
FIG. 3 is an exploded, perspective view of the banding tool of FIG. 1.
Figures 4, 5, 6:
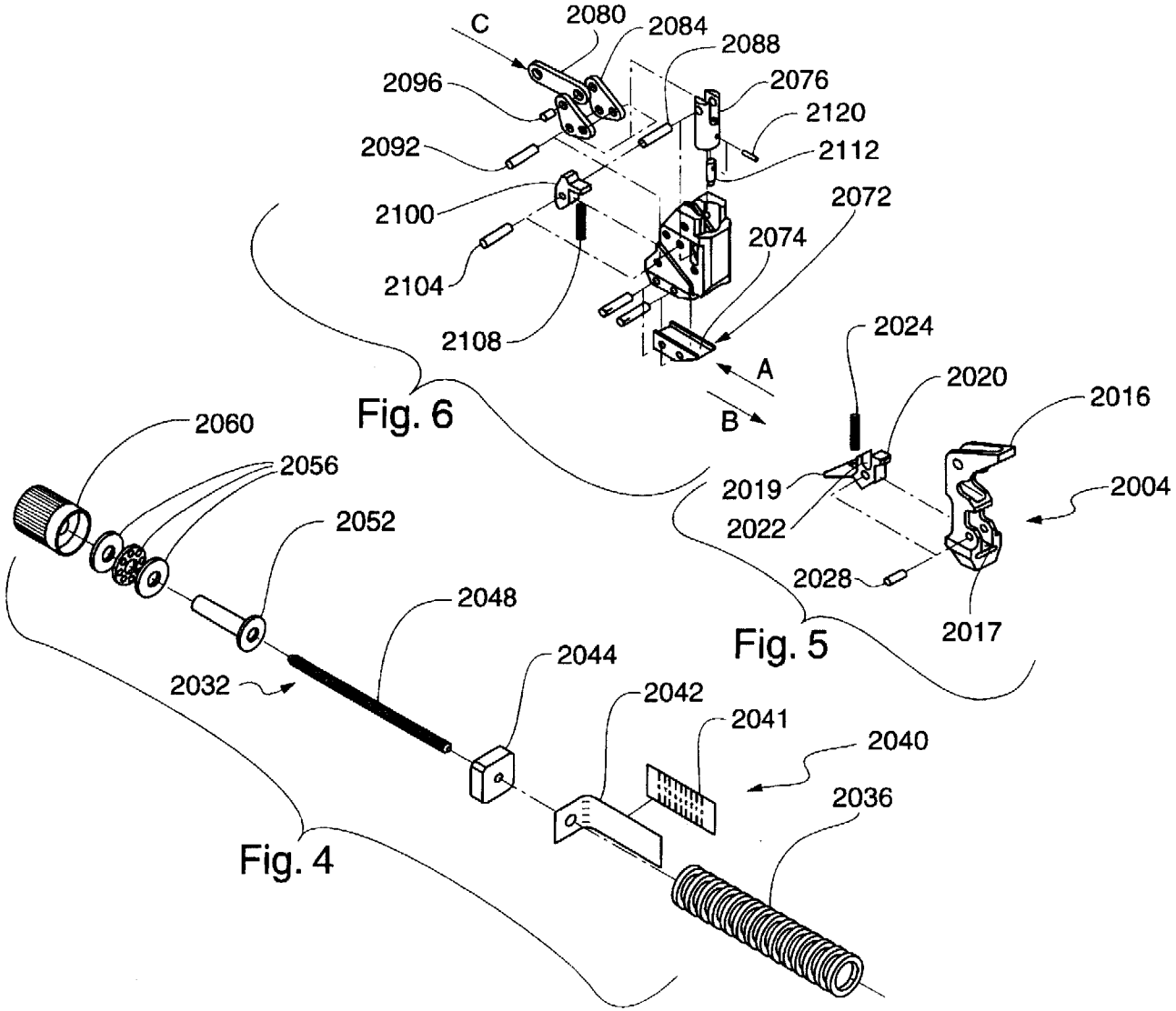
FIG. 4 is an exploded, perspective view of the plunger assembly from the banding tool of FIG. 1, the plunger assembly being for setting the tension which will be in the band after band tensioning operations are completed.
FIG. 5 is an exploded, perspective view of the band tensioning assembly from the banding tool of FIG. 1.
FIG. 6 is an exploded, perspective view of the band locking/cutting assembly for the banding tool of FIG. 1.
Figure 9:
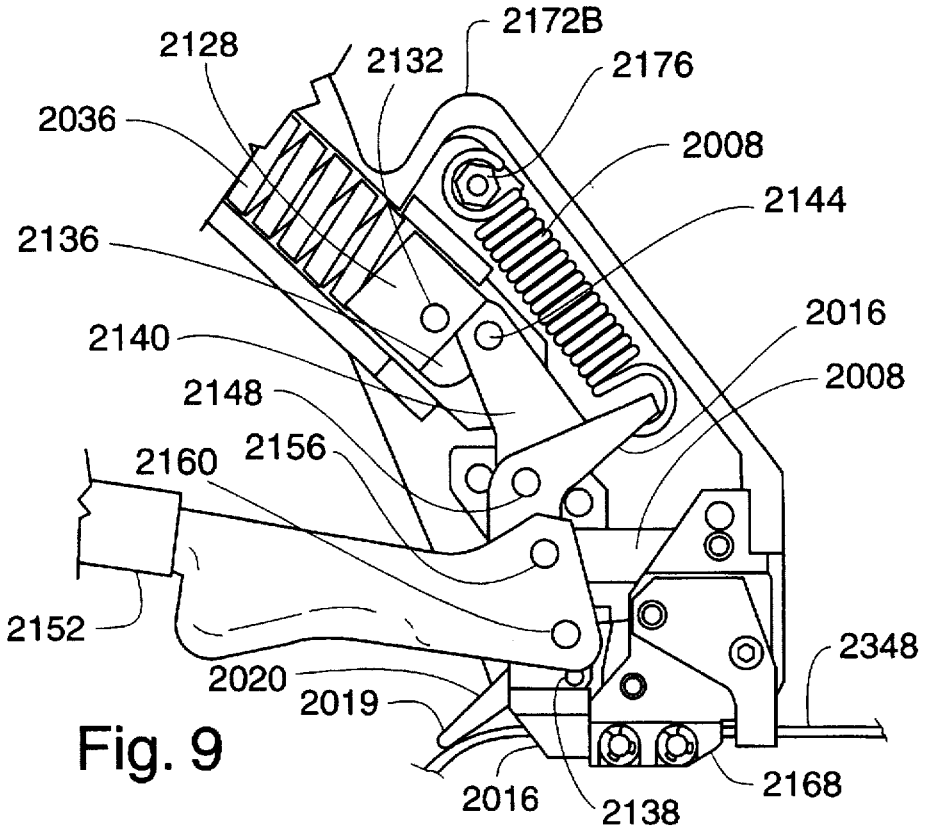
FIG. 9 is a cutaway side view of the banding tool of FIG. 1 with the band loaded and with the handle in a static position.

The banding tool 2000 allows the user to preset the tension which will be in the band after clamping operations have been completed. Referring principally to FIGS. 3–4, the banding tool 2000 includes a plunger assembly 2032 which operatively interfaces with the toggle assembly 2124, which in turn operatively interfaces with the band tensioning assembly 2004 through the handle 2152 in a manner discussed in more detail below. Generally, a comparison is made between the force being exerted on the toggle assembly 2124 by the plunger assembly 2032 and that force being exerted on the toggle assembly 2124 by the handle 2152 which is associated with the tension in the band. When the ratio of the force being exerted on the toggle assembly 2124 by the plunger assembly 2032 to that force being exerted on the toggle assembly 2124 by the tension in the band is greater than a predetermined amount, the handle 2152 will pivot about a first point and each power stroke of the handle 2152 will further increase the tension in the band. Once the ratio of the force being exerted on the toggle assembly 2124 by the plunger assembly 2032 to the force being exerted on the toggle assembly 2124 by the tension in the band is less than the noted predetermined amount, the pivot point of the handle 2152 will be moved to a second pivot point which is different from the first pivot point. The next power stroke of the handle 2152 by a pivoting of the same about this second pivot point will cause the band to be locked and cut through actuation of the band locking/cutting assembly 2064 by the handle 2152.

The plunger assembly 2032 includes a plunger assembly spring 2036 which operatively interfaces with the toggle assembly 2124. The amount of compression of the plunger assembly spring 2036 determines the tension which will be provided in the band at the completion of band tensioning operations. Varying the degree of compression of the plunger assembly spring 2036 changes the amount of tension which will be in the band at the completion of band tensioning operations. Adjustment of the amount of compression of the plunger assembly spring 2036 is available to the user of the banding tool 2000 by an adjustment knob 2060 which is disposed externally of the body 2172. Rotation of the adjustment knob 2060 in one direction further compresses the plunger assembly spring 2036 which will result in the tension in the band being greater at the end of band tensioning operations than prior to the noted adjustment of the knob 2060. Rotation of the adjustment knob 2060 in the opposite direction reduces the amount of compression of the plunger assembly spring 2036 which will result in the tension in the band being less at the end of band tensioning operations band than prior to the noted adjustment of the knob 2060.

The interface between the adjustment knob 2060 and the plunger assembly spring 2036 is provided by a multiplicity of components. Initially, a tension cap 2052 is interconnected with the adjustment knob 2060, and in the illustrated embodiment a thrust bearing assembly 2056 is disposed between the interior end of the adjustment knob 2060 and the enlarged end of the tension cap 2052. Rotation of the adjustment knob 2060 rotates the tension cap 2052, which in turn rotates a threaded stud 2048 which extends through the interior of the plunger assembly spring 2036 and which is threadably engaged with the interior of the tension cap 2052. The stud 2048 is also threadably interconnected with a tension block 2044. Rotation of the adjustment knob 2060 in one direction causes the tension block 2044 to retract toward the adjustment the 2060 to reduce the amount of compression of the plunger assembly spring 2036, while rotation of the adjustment knob 2060 in the opposite direction will cause the tension block 2044 to advance away from the adjustment knob 2060 to increased the amount of compression of be plunger assembly spring 2036. Visual indications to the user of the amount of tension which will be produced in the band based upon the current setting for the plunger assembly 2032 is provided by an indicator assembly 2040 (FIG. 4). Tension gradations are provided on a tension indicator 2041 which is attached to the second body housing 2172B and visible from the exterior thereof. A marker 2042 is disposed between the tension block 2044 and the plunger assembly spring 2036, and moves as the tension block 2044 moves in response to rotation of the adjustment knob 2060 by the user. The marker 2042 includes a single marking which is visible from the exterior of the body 2172, as well as on the tension gradations provided on the tension indicator 2041.

The plunger assembly 2032 preloads the toggle assembly 2124 for purposes of establishing the tension which will be in the band at the completion of band tensioning operations. The plunger assembly spring 2032 engages and acts upon the toggle assembly 2124 through a tension plunger 2128. A pair of tension plunger guides 2200 are provided on the interior of both body housings 2172 to slidably receive and axially guide the tension plunger 2128. The position of the tension plunger 2128 relative to the tension plunger guides 2200 is dependent upon the tension within the band and the forces being generated by the compressed plunger assembly spring 2036.

The toggle assembly 2124 includes a first toggle linkage 2136 and a second toggle linkage set 2140 (a pair of spaced part linkages). One end of the first toggle linkage 2136 is pivotally interconnected with the tension plunger 2128 by a pivot pin 2132. Each end of the pin 2132 is slidably received within a tension plate slot 2182 in a corresponding tension plate 2188 which limits movement of the pin 2132 in an axial direction. One tension plate 2188 is associated with the first body housing 2172A and another tension plate 2188 is associated with the second body housing 2172B, each tension plate 2188 being fixedly attached to the body 2172 by a screw 2190.

The opposite end of the first toggle linkage 2136 (i.e., opposite that end which interfaces with the tension plunger 2128 in the noted manner) is pivotally interconnected with the second toggle linkage set 2140 by a pivot pin 2144 disposed on one end of the second toggle linkage set 2140. The opposite end of the second toggle linkage set 2140 is in turn a fork 2142 which engages and controls the position of a handle pin 2156 associated with the handle 2152. The handle pin 2156 is fixedly interconnected with the handle 2152 which, as noted above, may be used to control band loading operations, band tensioning operations, and band locking/cutting operations. With the second toggle linkage set 2140 being pivotally interconnected with the body 2172 by a pin 2148 at a location between the fork 2142 and the pin 2148, the pin 2144 provides the toggle between the first toggle linkage 2136 and the second toggle linkage set 2140. Toggling the pin 2144 between its two positions determines which of the two pivot points about which the handle 2152 will pivot on its power stroke.

In order for the pin 2144 to toggle between its two positions, the pin 2148 about which the second linkage set 2148 pivots must be maintained in a fixed position relative to the body 2172. A body plate recess 2184 is formed on the interior of each of the first body housing 2172A and the second body housing 2172B, and one body plate 2180 is disposed in each of these two body plate recesses 2184. Each body plate 2180 includes a hole for receiving and end portion of the pin 2148. Since the body plate slot 2184 is contoured to matingly receive its associated body plate 2180, and further since each body plate 2180 is fixedly secured to the body 2172 by screws 2181, the position of the pin 2148 is fixed relative to the body 2172. As such, the pin 2144 is able to toggle between two positions for purposes of dictating whether power strokes of the handle 2152 provide band tensioning operations or band locking/cutting operations.

Band loading and band tensioning operations are each performed with the handle pin 2156 being in its first position and with the toggle pin 2144 being in its first of two positions. Each of the above-noted body plates 2180 includes an axially extending slot 2182 in which each end of the handle pin 2156 is disposed. The first position of the handle pin 2156 corresponds with the pin 2156 being forcibly retained by the toggle assembly 2124 (specifically by the fork 2142 of the second toggle linkage set 2140) against the end 2185 of each slot 2182 in the body plate 2180. With the handle pin 2156 being fixed against the end 2185 of the slot 2182 of the body plate 2180, and with each of the body plates 2180 being fixed relative to the body 2172, pivoting of the handle 2152 in a clockwise direction in the view presented in FIG. 50 requires the handle 2152 to pivot about the handle pin 2156.

The first position of the toggle pin 2144 (which provides for band loading and/or tensioning operations) is generally illustrated in FIG. 49 and will be discussed in more detail below, as well as the manner in which the toggle pin 2144 moves or toggles between its two positions. Both band loading and band tensioning operations involve/utilize the band tensioning assembly 2004 which is illustrated in detail in FIGS. 50 and 52, as well as the handle 2152 which operatively interfaces with the band tensioning assembly 2004 and which is the actuator for each of these particular operations. Principal components of the band tensioning assembly 2004 include a pull-up lever 2016 which is pivotally interconnected with the second toggle linkage set 2140 by the pin 2148 (which is again maintained in a fixed position relative to the body 2172), as well as a gripper 2020 which is pivotally interconnected with the pull-up lever 2016 by a gripper pivot pin 2028. The handle 2152 operatively interfaces with the pull-up lever 2016 through a gripper actuator pin 2160 which is fixedly interconnected with an end of the handle 2152. The gripper actuator pin 2160 is disposed within a gripper recess 2022 of the gripper 2020 and is laterally displaced from the gripper pivot pin 2028. Movement of the handle 2152 relative to the body 2172 exerts forces on the gripper 2020 to attempt to pivot the gripper 2020 about its gripper pivot pin 2028 and relative to the body 2172. Pivoting of the handle 2152 in a counterclockwise direction in the type of view of FIG. 50 causes the gripper 2020 to pivot in a clockwise direction about the gripper pivot pin 2028 and relative to the pull-up lever 2016. Sufficient clearance is provided by this type of pivoting motion of the handle 2152 such that a band (not shown) may be loaded between the gripper 2020 and a base 2017 of the pull-up lever 2016 (i.e., clockwise movement of the gripper 2020 about its gripper pivot pin 2028 moves the gripper 2020 away from the base 2017 of the pull-up lever 2016). One end of the band is then first inserted through a head 2068 of the banding tool 2000, which includes components of both the band tensioning assembly 2004 and the band locking/cutting assembly 2064 discussed in more detail below, and than through the pull-up lever 2016 between its base 2017 and the gripper 2020 in preparation for band tensioning operations.

Any attempted counterclockwise movement of the gripper 2020 about the gripper pivot pin 2028 causes the gripper 2020 to move toward the base 2017 of pull-up lever 2016 to forcibly retain the band therebetween. Two events provide this counterclockwise movement. Biasing forces are applied to the gripper 2020 by a gripper spring 2024 which is seated within the pull-up lever 2016 and which acts on the gripper 2020 at a location offset from the gripper pivot in 2028. Since the gripper spring 2024 is disposed distally or rearwardly of the gripper pivot pin 2028, the gripper 2020 is biased toward a counterclockwise movement to provide the noted result. Pivoting of the handle 2152 in a clockwise direction in the view illustrated in FIG. 50 likewise causes the gripper 2020 to attempt to pivot in a counterclockwise direction the gripper pivot pin 2028 and relative to the pull-up lever 2016. With the handle pin 2156 being retained within a fixed position by the fork 2142 of the second toggle linkage set 2136 of the toggle assembly 2124 in a manner discussed in more detail below, pivoting of the handle 2152 in a clockwise direction in the view presented in FIG. 50 thereby causes the pull-up lever 2016 to pivot about the pin 2148 in a clockwise direction move away from the head 2068 and to thereby advance the band relative to the head 2068 to remove slack in the band and/or to increase the tension in the band. The band more specifically moves in the direction of the arrow A illustrated in FIG. 57 and which will be discussed in more detail below.

One power stroke of the handle 2152 is typically insufficient for purposes of attaining the desired end tension for the band as established by the plunger assembly 2032 in accordance with the above discussion. As such, a return spring 2008 is provided to return both the handle 2152 and the pull-up lever 2016 into position for another power stroke of the handle 2152, or to the neutral position for the handle 2152. This is provided by a counterclockwise movement of the pull-up lever 2016 about the pivot pin 2148 and by a corresponding counterclockwise movement of the handle 2152 about the handle pin 2156 discussed below. One end of the return spring 2008 engages an upper portion of the pull-up lever 2016 (e.g., above the pivot pin 2148), while the other end of the return spring 2008 engages a post 2176 fixedly attached to the interior of the second body housing 2172B. Pivoting of the pull-up lever 2016 in a clockwise direction by a power stroke of the handle 2152 introduces sufficient tension within the return spring 2008 by extending the same to return the pull-up lever 2016 into a position in which it abuts the head 2068 and to return the handle 2152 to its neutral position.

During the above-noted counterclockwise movement of the pull-up lever 2016 and handle 2152 relative to the body 2172, there is also relative movement between the band being tensioned and the gripper 2020 in order for the gripper 2020 to be able to further increase the tension within the band (i.e., to allow the gripper 2020 to engage a longitudinally spaced portion of the band). Counterclockwise movement of the handle 2152 causes the gripper actuator pin 2160, associated with the handle 2152, to exert a force on the gripper 2020 which causes the gripper 2020 to pivot in a clockwise about the gripper pivot pin 2028, and thereby away from the base 2017 to allow for this type of band movement. The orientation of the gripping surface employed on the gripper 2020 may further facilitate this relative movement between the band and the gripper 2020. Notwithstanding the noted relative movement between the band and the gripper 2020, the tension within the band is substantially retained between power strokes of the handle 2152.

A holding gripper 2100 of the band tensioning assembly 2004 is disposed within the head 2068 of the banding tool 2000 and is pivotally interconnected with the head 2068 by a pin 2104 as illustrated in FIG. 6. The band is disposed between this holding gripper 2100 and a base 2074 of a blade 2072 (part of the band locking/cutting assembly 2064 discussed below) which is appropriately interconnected with the head 2068. The holding gripper 2100 allows the band to move relative to the head 2068 in the direction of be arrow A in FIG. 6 (i.e., during a band tensioning stroke), but substantially prevents the band from moving relative to the head 2068 in the direction of the arrow B in FIG. 6 (i.e., during a return stroke of the handle 2152 for a subsequent band tensioning stroke or for a band locking/cutting stroke). The holding gripper 2100 is biased into a position to hold the band during a return stroke of the handle 2152 and the pull-up lever 2106 by a spring 2108. Movement of the band in the direction of the arrow A during tensioning of the band causes the holding gripper 2100 to pivot in a clockwise direction in the view illustrated in FIG. 6 and to thereby allow the band to move relative to the holding gripper 2100 in the direction of the arrow A. Any attempted movement of the band in the direction of the arrow B, however, causes the holding gripper 2100 to pivot in a counterclockwise direction to exert an increasing binding force on the band to substantially retain the tension within the band. Once again, the holding gripper 2100 is biased into its tension holding position by the spring 2108.

When there is a predetermined relationship between the band tension and the forces stored within the plunger assembly spring (i.e., when the ratio of the force of the plunger assembly spring 2036 exerted on the toggle assembly 2124, transmitted via the tension plunger 2128 to the first toggle link 2136 and then to the toggle pivot pin 2144, to the band tension, transmitted via the handle 2152 to the toggle pivot pin 2144 through the handle pin 2156, exceeds a predetermined amount), the toggle pin 2144 toggles to its second position. This causes the second toggle linkage set 2140 to pivot in a counterclockwise direction about the pin 2148 whose position is fixed relative to the body 2172, which in turn causes the fork 2142 on the one end of the second toggle linkage set 2140 to move the handle pin 2156 within the recess 2018 of the pull-up lever 2016, which in return causes the handle pin 2156 to be displaced from the end 2185 of the body plate slot 2182 to an immediate location therein. Since the handle pin 2156 is no longer restrained by the body plate slot 2182, this then transfers the pivot point for the handle 2152 and also transfers the banding tool 2000 from band tensioning operations to band locking/cutting operations using the band cutting assembly 2064.

The band cutting assembly 2064 generally includes a knife 2076, which is vertically reciprocable within an appropriately configured cavity within the head 2068, and a stationary blade 2072, which is fixedly attached to the lower portion of the head 2068. An appropriate linkage interconnects the handle 2152 with the knife 2076, and in the illustrated embodiment this includes a cutoff link 2080 and a cutoff lever 2084. The handle pin 2156 of the handle 2152 is pivotally interconnected with one end of the cutoff link 2080. The opposite end of the cutoff link 2080 is pivotally interconnected with the cutoff lever 2084 by a pin 2096. Cutoff lever 2084 in turn is pivotally interconnected with the knife 2076 by a pin 2088 and is pivotally interconnected with the head 2068 of the banding tool 2000 by a pivot pin 2092. The pin 2092 is disposed at an intermediate location between the pin 2096 and the pin 2088.

With the handle pin 2156 being disposed away from the end 2185 of the body plate slot 2182 in each of the two body plates 2180 by the above-noted toggling of the toggle pivot pin 2144 discussed above, the pivot point of the handle 2156 now becomes the above-discussed gripper actuator pin 2160. Although the fork 2142 of the second linkage set 2140 still controls the position of the handle pin 2156 to a degree by maintaining an interfacing relationship therewith, pivoting of the handle 2152 would not require the handle 2152 to pivot about the pin 2156 when such is disposed at an intermediate location within the body plate slot 2182 of each of the body plates 2180. During subsequent pivoting of the handle 2152 about the gripper actuator pin 2160 by a clockwise motion from the view illustrated in FIG. 3, the handle pin 2156 forces the cutoff link 2080 in the direction of the arrow C of FIG. 6. Movement of the cutoff link 2080 in the direction of the arrow C illustrated in FIG. 6 causes the cutoff lever 2084 to pivot in a clockwise direction about the pin 2092. Clockwise pivoting of the cutoff lever 2084 then causes the knife 2076 to advance toward the stationary blade 2076 to both lock and cut the band, such as in any one of the above-described manners depending upon the particular configuration of the knife 2076 and the blade 2076. Subsequent counterclockwise pivoting of the handle 2152 in the view illustrated in FIG. 3 causes the toggle pin 2144 to return to its original position for subsequent band loading and/or tensioning operations.

Figure 7:
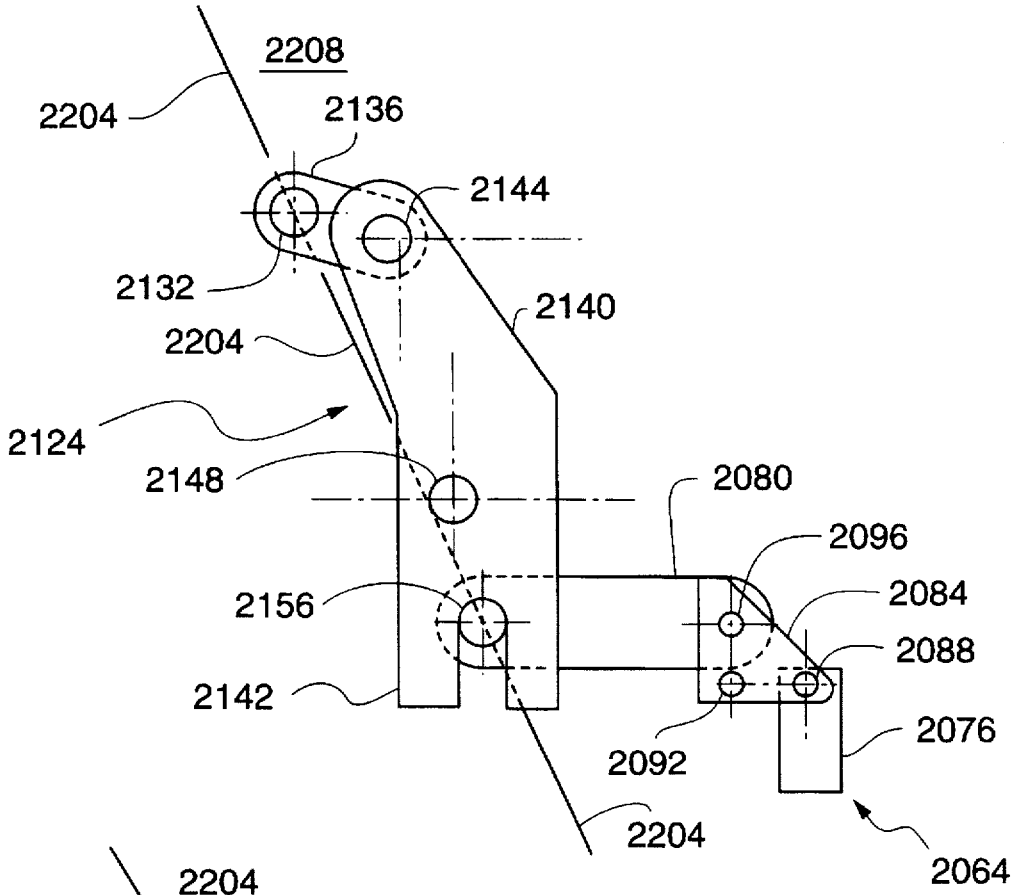
FIG. 7 is a side view of the toggled linkage system for the banding tool of FIG. 1, the toggled linkage system being in position for band tensioning operations.

Operation of the banding tool 2000 will be summarized in relation to FIGS. 7–13. Both band loading and band tensioning operations are executed with the toggle pin 2144 being in its first position as noted above. The first position of the toggle pivot pin 2144 is when the toggle pivot pin 2144 is disposed above a reference line 2204 which extends through the centers of the pin 2132 and the pin 2148, or more specifically on the side 2208 of this reference line 2204 as illustrated in FIG. 7. With the toggle pivot pin 2144 in this first position, this causes the fork 2142 of the second toggle linkage set 2140 to restrain the handle pin 2156 of the handle 2152 in its first position. The first position of the handle pin 2156 corresponds with the handle pin 2156 engaging the end 2185 of the body plate slot 2182 of each of the two body plates 2180. This requires the handle 2152 to pivot about the handle pin 2156 as noted above. Both band loading and tensioning operations are actuated with the handle pin 2156 in this position.

Figure 8:
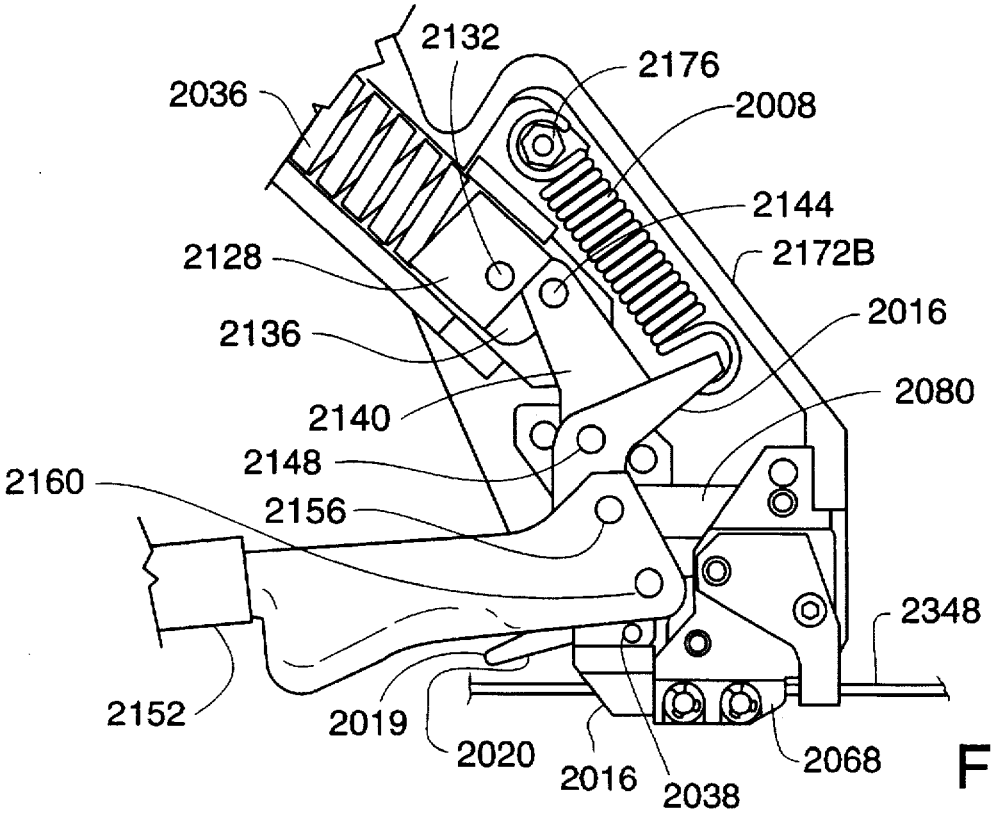
FIG. 8 is a cutaway side view of the banding tool of FIG. 1 with the handle being positioned for band loading operations.

Loading of the band may be affected by pivoting the handle 2152 in a counterclockwise direction from the position illustrated in FIG. 2 to the position illustrated in FIG. 8. This causes the gripper 2020 to pivot in a clockwise direction by the gripper actuator pin 2160 of the handle 2152, disposed within the recess 2022 of the gripper 2020, exerting a force on the gripper 2020 to pivot the same in a clockwise direction about the gripper pivot pin 2028. This allows a free end of a band 2348 to freely pass between the gripper 2020 and the base 2017 of the pull-up lever 2016. Release of the handle 2152 causes the handle 2152 to pivot in a clockwise direction in the view illustrated in FIG. 8 and to assume the position illustrated in FIG. 9 which is its neutral position. In this position, the gripper 2020 forcibly engages the band 2348 against the base 2017 of the pull-up lever 2016 for tensioning operations. This is initially provided by the gripper spring 2024 exerting a biasing force on the gripper 2020 which biases the gripper 2020 in a counterclockwise motion about the gripper pivot pin 2028 to forcibly engage the band 2348. As an alternative to using the handle 2156 for moving the gripper 2020 into position for effective band loading operations, the tail 2019 of the gripper 2020, which is accessible exteriorly of the body 2172 of the banding tool 2000, may be engaged by the user to pivot the gripper 2020 in the noted direction for band loading operations. However, this will typically require the use of both of the user's hands on the banding tool 2000.

Figure 10:
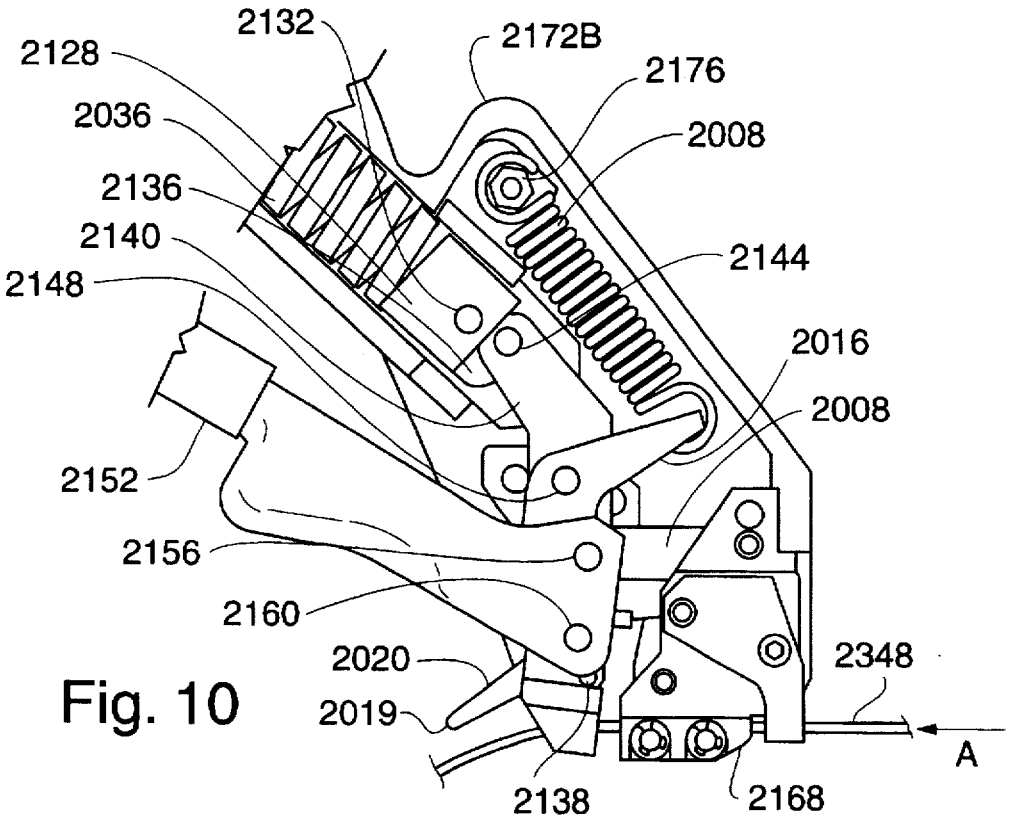
FIG. 10 is a cutaway side view of the banding tool of FIG. 1 with the handle being pivoted of its first pivot point for actuating band tensioning operations.

After the band has been appropriately loaded into the band tool 2000, band tensioning operations may be initiated. Pivoting of the handle 2152 in a clockwise direction of the handle pin 2156, from the position illustrated in FIG. 9, toward the body 2172 of the banding tool 2000 as illustrated in FIG. 10, activates the band tensioning assembly 2004. The described motion of the handle 2152 more specifically causes the pull-up lever 2016 to pivot about the pin 2148 in a clockwise direction. This is due to the forces exerted on the pull-up lever 2016 by the gripper actuator pin 2160 fixedly associated with the handle 2152, and results in the pull-up lever 2016 moving away from the head 2068. Movement of the band in the direction of the arrow A in FIG. 10 is thereby affected to tension the band 2348 about the object being clamped. During this movement of the band 2348, the holding gripper 2100 (FIG. 6) pivots in a clockwise direction about the pin 2104 to allow the band 2348 to pass thereby.

Multiple power strokes of the handle 2152 are typically required in order for the band 2348 to reach the desired tension as established by the plunger assembly 2032. Once the handle 2152 has been pivoted into engagement with the body 2172 at the end of a power stroke, the handle 2152 may be pivoted in a counterclockwise direction. Pivoting of the handle 2152 at this time is still about the handle pin 2156 which continues to be retained against the end 2185 of the body plate slot 2182 of each of the body plates 2180 by the toggle assembly 2124. During this movement of the handle 2152, the gripper 2020 slides over/above the upper surface of the band 2348 do to the pivotal connection of the gripper 2020. Tension within the band 2348 during the return stroke of the handle 2152 is maintained by the holding gripper 2100 disposed within the head 2068. Holding gripper 2100 forcibly engages the band against the base 2074 of the blade 2072. The return stroke of the handle 2152 and the corresponding pivoting of the pull-up lever 2016 in a counterclockwise direction about the pin 2148 is assisted by the return spring 2008.

Figure 12:
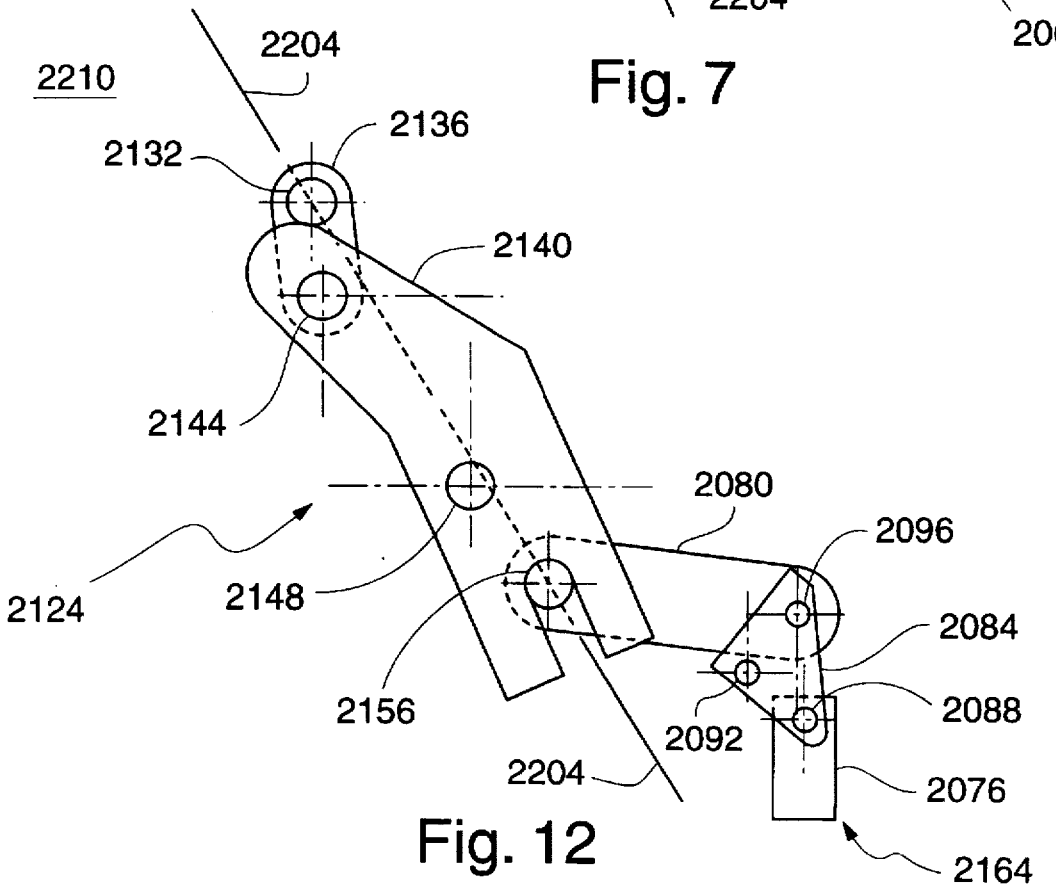
FIG. 12 is a side view of the toggled linkage system for the banding tool of FIG. 1, the toggled linkage system being in position for band cutting operations.
Figure 11:
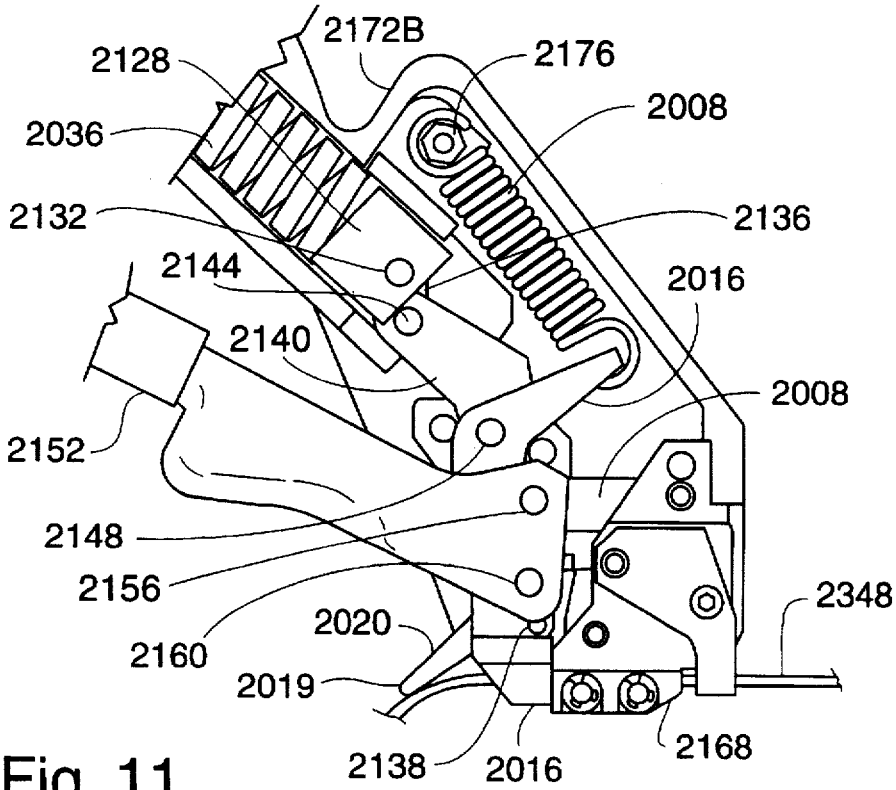
FIG. 11 is a cutaway side view of the banding tool of FIG. 1 after the band tension has reached the tension set through its plunger assembly, specifically the collapsing of the toggled linkage system to change the pivot point for the handle.
Figure 13:
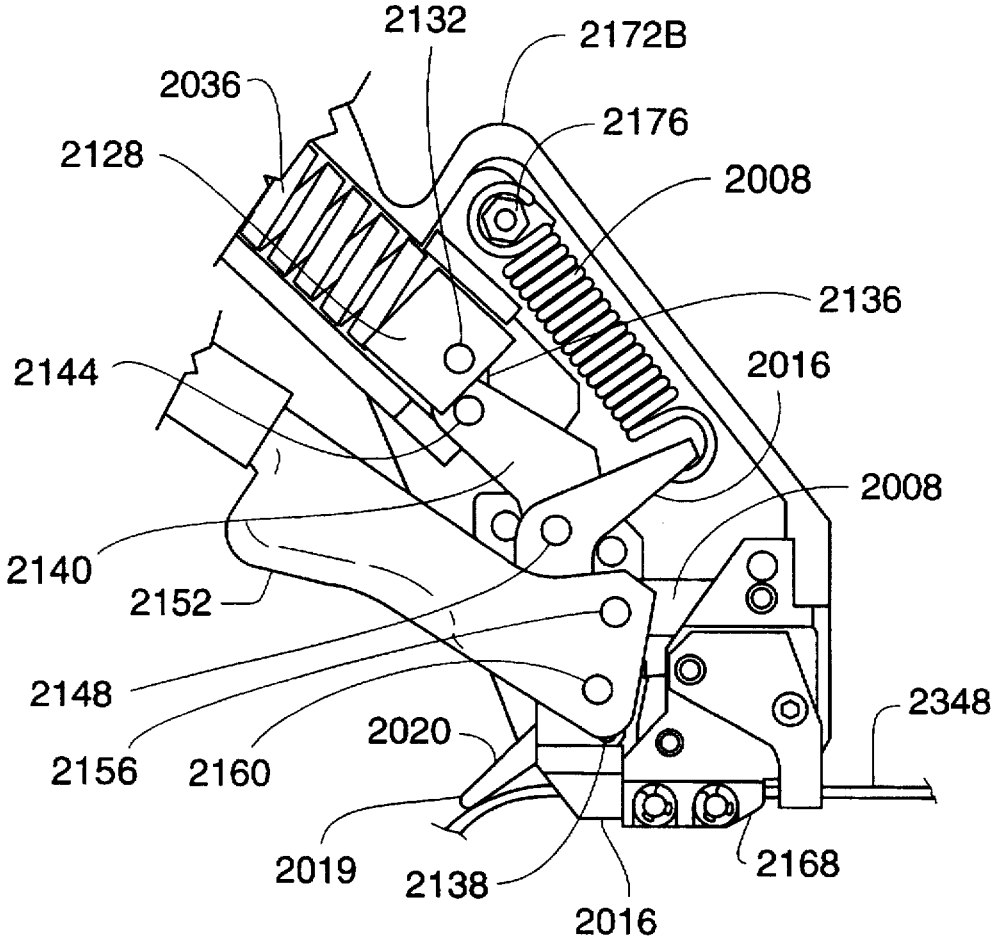
FIG. 13 is a cutaway side view of the banding tool of FIG. 1, with the handle being pivoted for band locking/cutting operations.
Figure 14A:
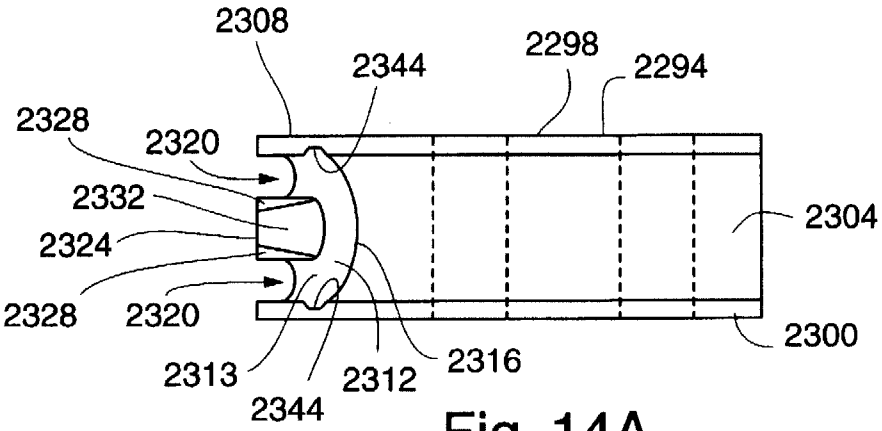
FIGS. 14A–D are views of another embodiment of a blade which may be used in the band cutting assembly for the banding tool of FIG. 1.
Figure 14B:
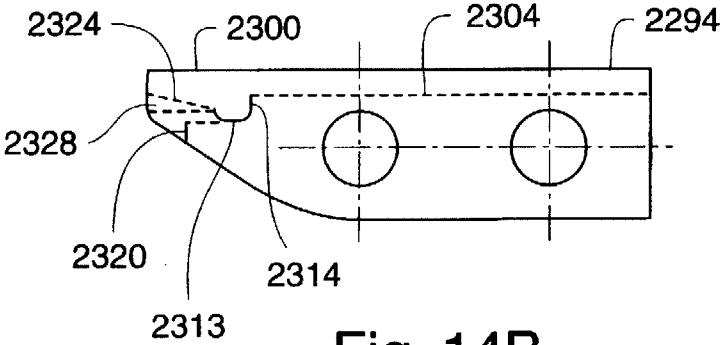
Figure 14D:
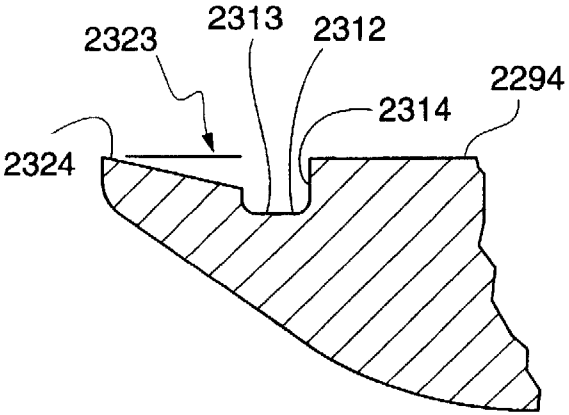
Figure 14C:
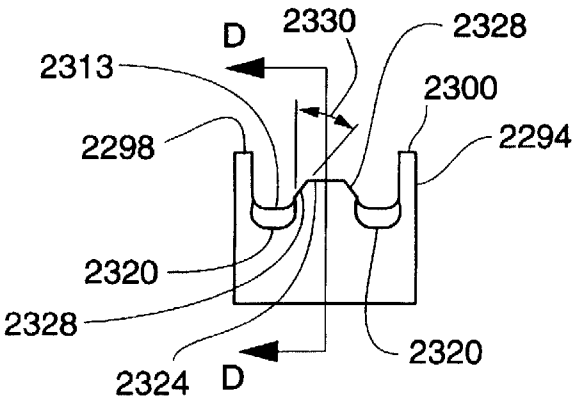
Figure 15C:
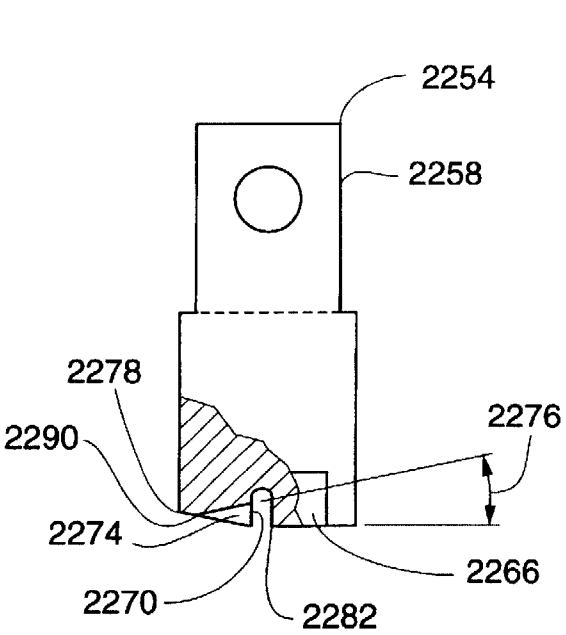
FIGS. 15A–D are views of an embodiment of a knife which may be used with the blade of FIGS. 14A–D.
Figure 15B:
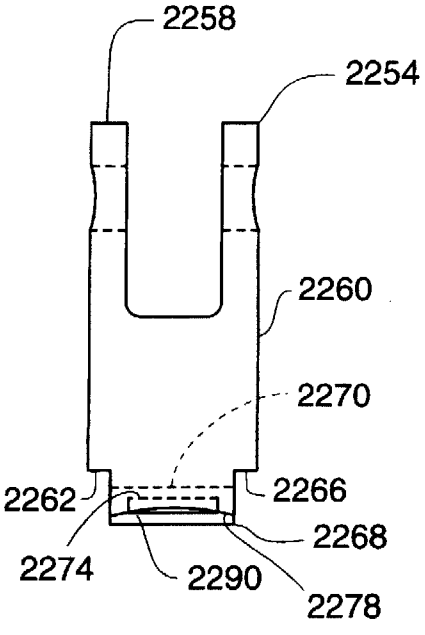
Figure 15A:
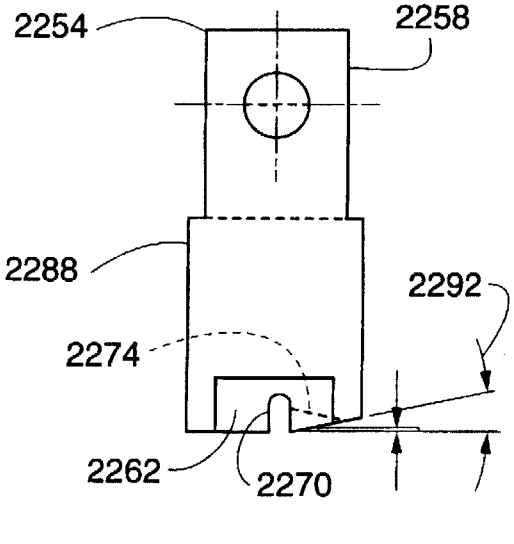
Figure 15D:
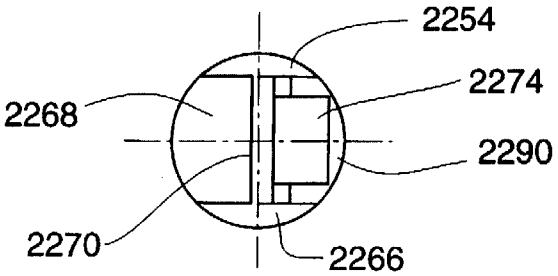
Figure 16A:
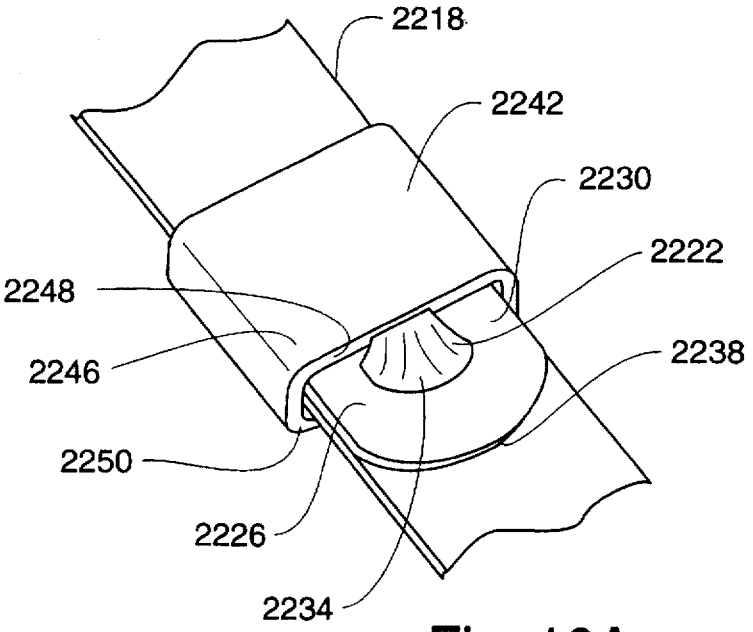
FIGS. 16A–D are views of a lock for a banding clamp provided by the blade of FIGS. 61A–D and the knife of FIGS. 15A–D.
Figure 16B:
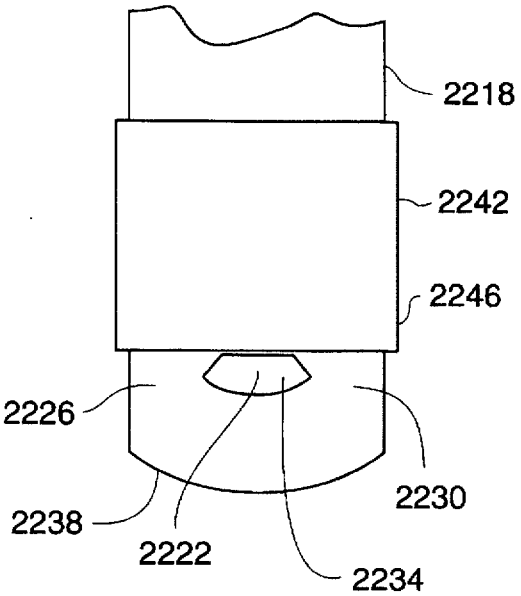
Figure 16C:
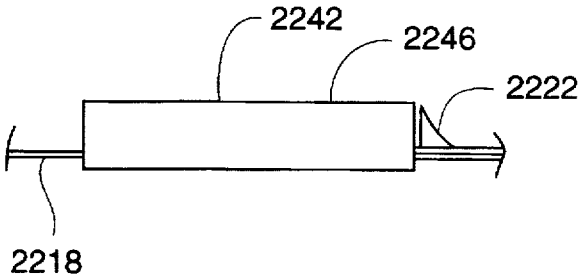
Figure 16D:
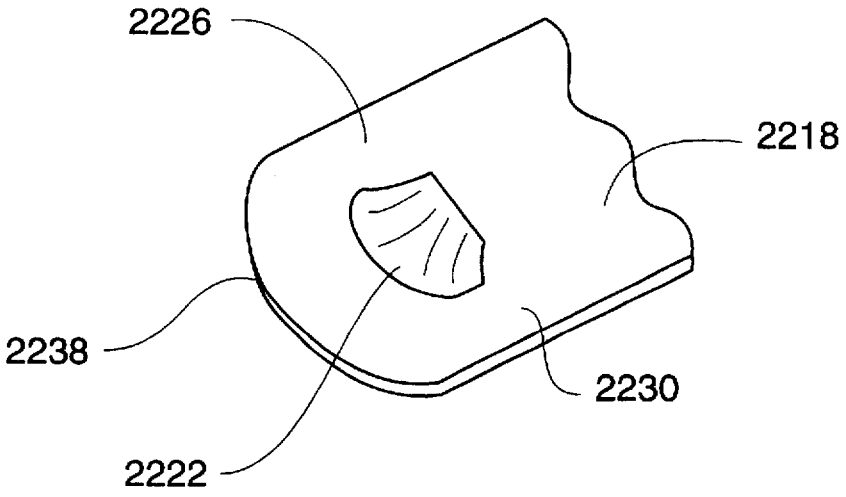

When the tension within the band exceeds the tension established by the plunger assembly 2032, the toggle pin 2144 toggles to its second position as illustrated in FIGS. 11–12. In the second position the toggle pin 2144 is disposed below the reference line 2204 or on the side 2210 of the reference line 2204 as illustrated in FIG. 12. Reference line 2204 again extends from the center of the pin 2132, which is the pivotal interconnection between the tension plunger 2128 and the first toggle link 2136, to the pin 2148, which is the pivotal connection between the second toggle linkage set 2140 and the body 2172. Movement of the toggle pin 2144 from the position illustrated in FIG. 7 to the position illustrated in FIG. 12 caused by movement of the handle pin 2156 away from the end 2185 in the body plate slot 2184 of each of the body plates 2180. As a result, the pivot point of the handle 2152 is changed from the handle pin 2156 to be gripper actuator pin 2160 since the handle pin 2156 is now movable within the body plate slot 2148, although still under the control of the toggle assembly 2124.

With the changing of the pivot point for the handle 2152 from its first position to its second position, the next power stroke of the handle 2152 activates the band cutting assembly 2064. Pivoting of the handle 2152 in a clockwise direction about the gripper actuator pin 2160 causes the handle pin 2156 to move the cutoff link 2080 in the direction of the arrow C illustrated in FIG. 6. Movement of the cutoff link 2080 in the direction of the arrow C illustrated in FIG. 6 causes the cutoff lever 2084 to pivot in a clockwise direction about the pin 2092 in the view presented in FIG. 6. This forces the knife 2076 toward the blade 2072 to lock and cut the band in a manner dictated by the configuration of the knife and/or blade.

An embodiment of the knife and blade for a band locking/cutting assembly, and which may be utilized with the banding tool 2000, is illustrated in FIGS. 14A–D and 15A–D. Referring initially to FIGS. 14A–D, a blade 2294 is illustrated therein which assists in the formation of the lock illustrated in FIGS. 16A–D to the discussed in more detail below. The blade 2294 generally includes a first side section 2298 and a second side section 2300 with a base 2304 disposed therebetween and recessed relative to an upper surface of the sections 2298 and 2300. Disposed on the forward portion of the blade 2294 is a locking/cutting section 2308 which interacts with the knife 2254 of FIGS. 15A–D to both lock and cut the band once the desired tension has been attained, including in accordance with the foregoing.

The locking/cutting section 2308 of the blade 2294 includes a recess 2312 defined by a generally vertically disposed wall 2314 and a generally horizontally disposed floor 2313, the floor 2313 being disposed at a lower elevation than the base 2304. At the intersection between the recess 2312 and each of the first side section 2298 and the second side section 2300 is an arcuately-shaped cutout 2344 which extends into the associated side section 2298 and 2300. In one embodiment, these cutouts 2344 are defined by a radius. Generally, the functionality of the cutouts 2344 is to ensure that radius 2316 is uninterrupted through base 2304.

The rearward portion of the recess 2312 is defined by an arcuate edge 2316. It is this edge 2316 which facilitates cutting across the entire width of the band along an arcuate path after the band is appropriately locked, and which provides a corresponding reduction in the amount of forces required by the operator to cut the band once tensioned. In one embodiment, this arcuate edge 2316 is defined by a radius, and a ratio of this radius to the distance between the inner walls of the first side section 2298 and the second side section 2300 is preferably no more than about seventy-five percent (75%). This particular ratio provides enough of an arcuate extent to desirably reduce the forces required to be exerted on the handle 2152 during cutting operations.

The locking/cutting section 2308 further includes a pair of laterally spaced and generally longitudinally extending notches 2320. These notches 2320 intersect with the floor 2313 of the recess 2312. A pommel 2324 is disposed between the notches 2320 and includes a central section 2332 which extends downwardly from the forward edge of the locking/cutting section 2308 at an angle 2323 of about 12°, and intersects with the recess 2312 at a location disposed vertically above its floor 2313. The pommel 2324 further includes a pair of laterally spaced side sections 2328. Each of these side sections 2328 extends outwardly away from a central, longitudinal axis of the blade 2294 at an angle 2330. In one embodiment, the angle 2330 is about 45°. Functionally, the pommel 2324 interacts with the knife 2254 to define the lock in the band (i.e., that portion of the band which abuts the buckle) in order to maintain the tension in the band after completion of tensioning operations.

The blade 2294 of FIGS. 14A–D interacts with the knife 2254 of FIGS. 15A–D to both lock and thereafter cut the band. The knife 2254 is generally cylindrically-shaped and includes a mounting section 2258 for interfacing with the cut-off lever 2084. The knife 2254 also includes a body 2260, the lower portion of which interacts with the above-described blade 2294. A first generally L-shaped cutout 2262 is formed on one side of the body 2260, while a second generally L-shaped second cutout 2266 is disposed on an opposite side of the body 2260. The first cutout 2262 and the second cutout 2266 are laterally spaced to define a central section 2268 therebetween.

The central section 2268 includes an angled surface 2290 which is disposed at an angle 2292 of about 12 degrees relative to a horizontal reference plane and which includes an arcuately-shaped, laterally extending (relative to the band being cut) first cutting edge 2278. It is this first cutting edge 2278 which interacts with the arcuate edge 2316 of the blade 2294 to cut the band across its entire width along an arcuate path after the lock has then defined and appropriately interface with the buckle.

A first slot 2270 is disposed in generally a mid portion the central section 2268 and extends laterally (i.e., substantially perpendicularly to the central, longitudinal axis of the blade 2294). A second cutting edge 2282 is defined by the edge of this first slot 2270. This second cutting edge 2282 introduces a laterally extending slit within the band in order to initiate definition of its lock. A second slot 2274 is disposed on a lower surface of the knife 2254, specifically on the angled surface 2290, and extends longitudinally (i.e., substantially parallel with the central, longitudinal axis of the blade 2294) to intersect with the first slot 2270. The base of the second slot 2274 is disposed at an angle 2276 of about 12° in one embodiment. Functionally, the second slot 2274 interacts with the pommel 2324 of the blade 2294 to form the lock on the band after the second cutting edge 2282 has introduced a slit within the band as noted.

The lock provided by the interaction of the knife 2254 with the blade 2294 is illustrated in FIGS. 16A–D. A band 2218 is illustrated after completion of band locking/cutting operations about and appropriated object. The lock 2222 interacts with a buckle 2242 attached to one end of the band 2218 to substantially retain the tension within the band 2218, such as provided by the banding tool 2000. The lock 2222 includes a first side section 2226 disposed on one side of the band 2218, a second side section 2230 disposed on the opposite side of the band 3018, and an intermediate section 2234 disposed therebetween. The intermediate section 2234 of the lock 2222 abuts against the surface end 2248 of the upper section 2246 of the buckle 2242 and is formed by the interaction of the pommel 2324 of the blade 2294 with the slot 2274 of the knife 2254. That is, the intermediate section 2234 of the lock 2222 is disposed at a greater distance from the lower section 2250 of the buckle 2242 than both of the first side section 2226 and the second side section 2230. As such, the immediate section 2234 provides for a locking engagement with the buckle 2242.

The foregoing description of the invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known of practicing the invention and to enable others skilled in the art to utilize the invention in such, or other, embodiments and with the various modifications required by the particular applications or uses of the invention. It is intended that the appended claims be construed to include alternative embodiments to the extent permitted by the prior art.

What is claimed:

1. A banding tool for tensioning a band about an object, comprising:

a banding tool housing;

a first handle associated with said banding tool housing;

a band tensioning assembly associated with said banding tool housing;

a band cutting assembly associated with said banding tool housing;

first means for actuating said band tensioning assembly, said first means for actuating comprising first means for pivoting said first handle substantially about a first pivot point in a first direction; and second means for actuating said band cutting assembly, said second means for actuating comprising second means for pivoting said first handle about a second pivot point different from said first pivot point and in said first direction, wherein when said second means for actuating said band cutting assembly is engaged said first handle pivots about said second pivot point and is disengaged from pivoting about said first pivot point.

2. A banding tool, as claimed in claim 1, wherein:

said first means for pivoting comprises a first handle pivot pin fixed relative to said first handle, said first handle pivot pin comprising said first pivot point.

3. A banding tool, as claimed in claim 2, wherein:

first means for pivoting comprises means for maintaining said first handle pivot pin in a substantially fixed position during tensioning operations.

4. A banding tool, as claimed claim 3, wherein:

said means for maintaining comprises a toggled linkage system.

5. A banding tool, as claimed in claim 2, wherein:

said first handle pivot pin is further operatively interfaceable with said band cutting assembly.

6. A banding tool, as claimed in claim 2, wherein:

said second means for pivoting comprises means for moving said first handle pivot pin away from said first pivot point.

7. A banding tool, as claimed in claim 6, wherein:

said means for moving comprises a toggled linkage system operatively interfaced with said first handle pivot pin.

8. A banding tool, as claimed in claim 2, further comprising:

means for controlling a position of said first handle pivot pin.

9. A banding tool, as claimed in claim 1, wherein:

said first means for pivoting and said second means for pivoting each comprise a common toggled linkage system.

10. A banding tool, as claimed in claim 1, wherein:

said band cutting assembly comprises means for cutting the band across an entire width of said band.

11. A banding tool, as claimed in claim 1, wherein:

said band cutting assembly comprises means for cutting the band across an entire width of said band along an arcuate path.

12. A banding tool, as claimed in claim 11, wherein:

said means for cutting comprises a knife with a first arcuate cutting edge and a blade with a second arcuate cutting edge which interacts with said first cutting edge.

13. A banding tool for tensioning a band about an object, comprising:

a banding tool housing;

a first handle associated with said banding tool housing;

a band tensioning assembly associated with said banding tool housing, said band tensioning assembly comprising a tensioning assembly housing comprising a base, said band tensioning assembly further comprising a gripper pivotally interconnected with said tensioning assembly housing by a gripper pivot pin, said gripper being displaceable from said base, wherein said first handle comprises a gripper actuator pin which is fixed relative to said first handle and which interfaces with said gripper, wherein a pivoting of said first handle in a second direction opposite said first direction substantially about said first pivot point pivots said gripper away from said base whereby a band may be freely moved between said gripper and said base;

a band cutting assembly associated with said banding tool housing;

first means for actuating said band tensioning assembly, said first means for actuating comprising first means for pivoting said first handle substantially about a first pivot point in a first direction; and second means for actuating said band cutting assembly, said second means for actuating comprising second means for pivoting said first handle substantially about a second pivot point different from said first pivot point and in said first direction.

14. A banding tool, as claimed in claim 12, wherein:

said gripper actuator pin is laterally spaced from said first pivot point.

15. A banding tool, as claimed in claim 12, wherein:

said gripper actuator pin is disposed further from a free end of said first handle than said first pivot point.

16. A banding tool, as claimed in claim 12, wherein:

said gripper comprises a slot, said gripper actuator pin of said first handle being disposed within said slot.

17. A banding tool for tensioning a band about an object, comprising:

a banding tool housing;

a first handle associated with said banding tool housing;

a band tensioning assembly associated with said banding tool housing, said tensioning assembly housing comprising a base;

a band cutting assembly associated with said banding tool housing;

first means for actuating said band tensioning assembly, said first means for actuating comprising first means for pivoting said first handle substantially about a first pivot point in a first direction;

second means for actuating said band cutting assembly, said second means for actuating comprising second means for pivoting said first handle substantially about a second pivot point different from said first pivot point and in said first direction;

a first handle pivot pin fixedly interconnected with said first handle, said first handle pivot pin comprising said first pivot point;

a gripper actuator pin fixedly interconnected with said first handle, said gripper actuator pin comprising said second pivot point;

a gripper pivotally interconnected with said tensioning assembly housing by a gripper pivot pin, wherein said band tensioning assembly comprises said tensioning assembly housing and said gripper and wherein said gripper actuator pin of said first handle operatively interfaces with said gripper;

a toggled linkage system operatively interfaced with said first handle pivot pin; and a cutter linkage system operatively interfaceable with said first handle pivot pin, said band cutting assembly comprising said cutter linkage system.

18. A banding tool, as claimed in claim 17, wherein:

said toggled linkage system comprises first and second linkages, said first linkage comprising third and fourth spaced pivot points and said second linkage comprising fifth and sixth spaced pivot points, said third pivot point operatively interfacing with a band tension setting device, said first and second linkages being pivotally interconnected at said fourth and fifth pivot points, said second linkage being pivotally interconnected with said banding tool housing at said sixth pivot point, said second linkage comprising a first handle pivot pin engagement member operatively interfaced with said first handle pivot pin, said sixth pivot point being disposed between said fifth pivot point and said first handle pivot pin engagement member.

19. A banding tool for tensioning a band about an object, comprising:

a banding tool housing;

a first handle associated with said banding tool housing;

a band tensioning assembly associated with said banding tool housing, said band tensioning assembly comprising a tensioning assembly housing comprising a base, said band tensioning assembly further comprising a gripper pivotally interconnected with said tensioning assembly by a gripper pivot pin, said gripper being displaceable from said base, wherein said first handle further comprises a gripper actuator pin which is fixed relative to said first handle and which operatively interfaces with said gripper, wherein a pivoting of said first handle in a second direction opposite said first direction about said first reference axis pivots said gripper away from said base whereby a band may be freely moved between said gripper and said base, said gripper actuator pin comprising said second pivot point;

a band cutting assembly associated with said banding tool housing;

first means for actuating said band tensioning assembly, said first means for actuating comprising first means for pivoting said first handle substantially about a first pivot point in a first direction, said first means for pivoting comprising a first handle pivot pin fixed relative to said first handle, said first handle pivot pin comprising said first pivot point; and second means for actuating said band cutting assembly, said second means for actuating comprising second means for pivoting said first handle substantially about a second pivot point different from said first pivot point and in said first direction, said second means for pivoting comprising means for moving said first handle pivot pin away from said first pivot point.

20. A method for installing a band clamp about an object with a banding tool comprising a first handle, a band tensioning assembly, and a band cutting assembly, said method comprising the steps of:

engaging said band with said band tensioning assembly;

performing a first pivoting step comprising pivoting said first handle about a first pivot point;

performing a first advancing step comprising advancing said band tensioning assembly using said performing a first pivoting step;

tensioning said band using said performing a first advancing step;

performing a second pivoting step comprising pivoting said first handle about a second pivot point after said tensioning step, said first and second pivot points being at different locations;

performing a second advancing step comprising advancing said band cutting assembly using said performing a second pivoting step; and cutting said band using said performing a second advancing step, wherein during said performing a second advancing step no tension remains associated with said first handle from said first advancing step.

21. A method, as claimed in claim 20, further comprising the step of:

maintaining said first pivot point in a substantially fixed position throughout said tensioning step.

22. A method, as claimed in claim 21, wherein said first handle comprises a first handle pivot pin, wherein:

said maintaining step comprises exerting a force on said first handle pivot pin.

23. A method, as claimed in claim 22, further comprising the step of:

presetting a desired tension for said band, wherein a magnitude used by said exerting a force step is based upon said presetting step.

24. A method, as claimed in claim 20, wherein:

said performing a first pivoting step comprises pivoting said first handle in a first direction and wherein said performing a second pivoting step comprises pivoting said first handle in said first direction.

25. A method, as claimed in claim 20, wherein said band tensioning assembly comprises a tensioning assembly housing comprising a base, said band tensioning assembly further comprising a gripper pivotally interconnected with said tensioning assembly housing by a gripper pivot pin, wherein said gripper is displaceable from said base, wherein:

said performing a first pivoting step comprises pivoting said first handle about said first pivot point in a first direction and exerting a force on said gripper to bias said gripper to pivot about said gripper pin in a second direction, opposite said first direction, into forcible engagement with said band.

26. A method, as claimed in claim 20, wherein:

said performing a first advancing step comprises pivoting said first handle about said first pivot point in a first direction.

27. A method, as claimed in claim 26, wherein:

said performing a second pivoting step comprises pivoting said first handle about said second pivot point in said first direction.

28. A method, as claimed in claim 20, wherein said first handle comprises a first handle pivot pin, said method further comprising the steps of:

forcibly retaining said first handle pivot pin substantially in a first position throughout said tensioning step; and moving said first handle pivot pin after said tensioning step, said first position of said first handle pivot pin comprising said first pivot point.

29. A method, as claimed in claim 28, wherein:

said performing a second advancing step is responsive to said moving said first handle pivot pin step.

30. A method, as claimed in claim 28, wherein:

said moving said first handle pivot pin step operatively interfaces said first handle pivot pin with said band cutting assembly.

31. A method, as claimed in claim 20, wherein said first handle comprises a first handle pivot pin, said method further comprising the step of:

controlling a position of said first handle pivot pin with a toggled linkage system.

32. A method, as claimed in claim 31, further comprising the step of:

preloading said toggled linkage system.

33. A method, as claimed in claim 32, further comprising the step of:

collapsing said toggled linkage system when a ratio of a magnitude of said tensioning step to a magnitude of said preloading step exceeds a predetermined amount.

34. A method, as claimed in claim 33, further comprising the step of:

moving said first handle pivot pin responsive to said collapsing step.

35. A method, as claimed in claim 20, wherein:

said cutting step comprises cutting said band across an entire width of said band with a cutting device, said cutting device interfacing with said entire width of said band.

36. A method, as claimed in claim 35, wherein:

said cutting said band cross an entire width of said band step comprises cutting along an arcuate path.

37. A method, as claimed in claim 36, further comprising the step of:

locking said band against a buckle.

38. A method, as claimed in claim 20, further comprising the step of:

loading said band in said band tensioning assembly before said performing a first pivoting step, said loading step comprising performing a third pivoting step comprising pivoting said first handle about said first pivot point, wherein said first handle is pivoted in a first direction during said performing a first pivoting step and is pivoted in a second direction, opposite said first direction, during said performing a third pivoting step.

39. A method, as claimed in claim 38, wherein said band tensioning assembly comprises a tensioning assembly housing comprising a base and a gripper pivotally interconnected with said tensioning assembly housing, said band being disposed between said gripper and said base, said method further comprising the step of:

pivoting said gripper away from said base responsive to said performing a third pivoting step.

40. A method, as claimed in claim 20, wherein:

said tensioning step is terminated prior to said cutting step.

41. A method, as claimed in claim 20, further comprising the step of:

maintaining said band at a single, predetermined tension throughout an entirety of said cutting step.

42. A banding tool for tensioning a band about an object, comprising:

a banding tool housing;

a first handle associated with said banding tool housing;

a band tensioning assembly associated with said banding tool housing;

a band cutting assembly associated with said banding tool housing;

first means for actuating said band tensioning assembly, said first means for actuating comprising first means for pivoting said first handle substantially about a first pivot point in a first direction; and second means for actuating said band cutting assembly, said second means for actuating comprising second means for pivoting said first handle about a second pivot point different from said first pivot point and in said first direction, wherein when said second means for actuating said band cutting assembly is engaged, no tension remains associated with said first handle from said first means for actuating said band tensioning assembly.

* * * * *